US007067779B2

(12) United States Patent
Mulcahy et al.

(10) Patent No.: US 7,067,779 B2
(45) Date of Patent: Jun. 27, 2006

(54) MAGNETRON ARRANGEMENT

(75) Inventors: Bernard R Mulcahy, Chelmsford (GB); Rodney Wale, Chelmsford (GB)

(73) Assignee: E2V Technologies (UK) Limited, Chelmsford (GB)

( * ) Notice: Subject to any disclaimer, the term of this patent is extended or adjusted under 35 U.S.C. 154(b) by 0 days.

(21) Appl. No.: 10/168,648

(22) PCT Filed: Dec. 21, 2000

(86) PCT No.: PCT/GB00/04931

§ 371 (c)(1),
(2), (4) Date: Nov. 4, 2002

(87) PCT Pub. No.: WO01/46985

PCT Pub. Date: Jun. 28, 2001

(65) Prior Publication Data

US 2003/0121911 A1 Jul. 3, 2003

(30) Foreign Application Priority Data

Dec. 21, 1999 (GB) ..... 9930110

(51) Int. Cl.
*H05B 6/70* (2006.01)

(52) U.S. Cl. ..... 219/690; 219/746; 219/761; 315/39.51

(58) Field of Classification Search ..... 219/690, 219/746, 761; 315/39.51, 39.53, 39.55, 39.57; 333/26, 113, 122, 230, 254
See application file for complete search history.

(56) References Cited

U.S. PATENT DOCUMENTS

| | | | | |
|---|---|---|---|---|
| 3,334,266 | A * | 8/1967 | Frutiger | 315/39.53 |
| 3,641,389 | A * | 2/1972 | Leidigh | 315/39 |
| 3,739,225 | A * | 6/1973 | Mims | 315/39.51 |
| 3,758,886 | A * | 9/1973 | Landry et al. | 333/26 |
| 4,139,828 | A * | 2/1979 | Commault et al. | 333/26 |
| 4,673,783 | A * | 6/1987 | Igarashi et al. | 219/749 |
| 5,216,327 | A * | 6/1993 | Myers et al. | 315/39.53 |
| 5,461,283 | A * | 10/1995 | Thornber et al. | 315/39.53 |
| 5,525,865 | A * | 6/1996 | Simpson | 315/39 |
| 5,838,212 | A * | 11/1998 | Pettit et al. | 333/26 |
| 5,894,198 | A * | 4/1999 | Miki et al. | 315/39.51 |
| 6,097,018 | A * | 8/2000 | Kim et al. | 219/746 |
| 6,097,154 | A * | 8/2000 | Choi | 315/39.51 |
| 6,114,676 | A * | 9/2000 | Jerby et al. | 219/690 |

FOREIGN PATENT DOCUMENTS

| | | |
|---|---|---|
| GB | 777485 | 6/1957 |
| GB | 2 280 541 A | 2/1995 |
| JP | 59-103340 | 6/1984 |

* cited by examiner

*Primary Examiner*—Robin O. Evans
*Assistant Examiner*—Leonid Fastovsky
(74) *Attorney, Agent, or Firm*—Kirschstein, et al.

(57) ABSTRACT

A magnetron arrangement has a coaxial output terminating in a probe which launches energy from the magnetron along a rectangular waveguide. The coaxial output is arranged in an endfire configuration with respect to the waveguide, giving a compact arrangement compared to conventional output designs.

5 Claims, 1 Drawing Sheet

MAGNETRON ARRANGEMENT

This invention relates to magnetron arrangements and more particularly to magnetron outputs.

Figure 1:
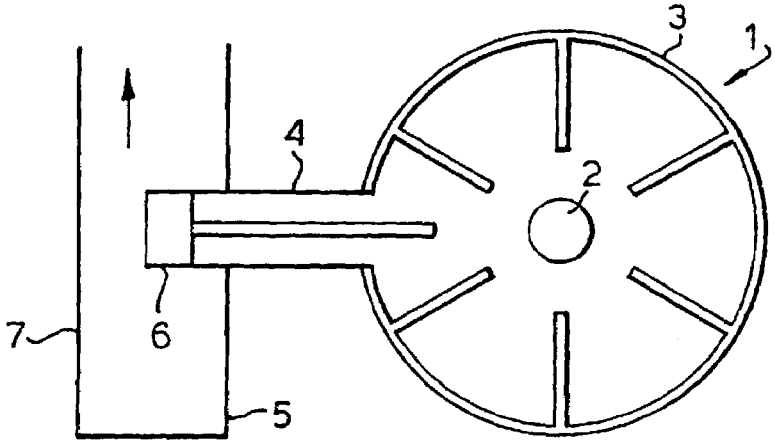

FIG. 1 schematically shows a magnetron 1 having a cathode 2 surrounded by an anode 3 with the output of the magnetron being coupled via a coaxial line 4 to a rectangular waveguide 5. The coaxial line 4 terminates in a probe 6 which extends through one of the broad walls of the waveguide 5. The output of the magnetron is transmitted along the waveguide 5 in the direction shown by the arrow. The probe 6 is spaced from an end wall 7, known as a backstop, by one quarter of a wavelength such that any radiation transmitted towards the end wall 7 adds constructively to the radiation transmitted along the waveguide 5.

According to the invention, there is provided a magnetron arrangement comprising a magnetron having a coaxial output which is coupled in an endfire configuration to a rectangular waveguide.

The present inventors have realised that the traditional technique for coupling the output of a magnetron into a rectangular waveguide need not be used. By employing the invention, a much more compact arrangement may be realised which also gives weight savings and a reduction in materials required. The endfire configuration is also particularly convenient for coupling to other parts of an r.f. system for which the magnetron supplies the power, for example. A particularly significant advantage of the invention is that it avoids the need to accurately locate a probe with respect to a backstop, reducing manufacturing time.

By "endfire configuration" it is meant that the coaxial output extends in the same direction as the direction in which energy is transmitted along the waveguide.

Preferably, the coaxial output is coupled directly to the rectangular waveguide, that is, there are no intervening transitional sections for converting a circular waveguide mode to a rectangular waveguide mode. Possibly a transition could be included but this would tend to undesirably increase the complexity and bulk of the arrangment without necessarily giving a significantly improved coupling between the coaxial output and the rectangular waveguide.

Preferably, the central conductor of the coaxial output is aligned with the edge of a broad wall of the rectangular waveguide and at its mid-point. This location gives optimum coupling between the two components.

The coaxial output may be located flush in a surrounding wall but preferably is surrounded by a cylindrical wall. This may be arranged to act as a harmonic choke around the coaxial output, presenting one quarter wavelength at the second or third harmonic of the operating frequency to filter power coupled from the magnetron at the undesired harmonic frequencies. Where a harmonic choke is included in the coaxial to waveguide transition, other dimensions used to match the coaxial output to the waveguide are modified so as to incorporate the inductance of the choke at the operating frequency.

Figure 2:
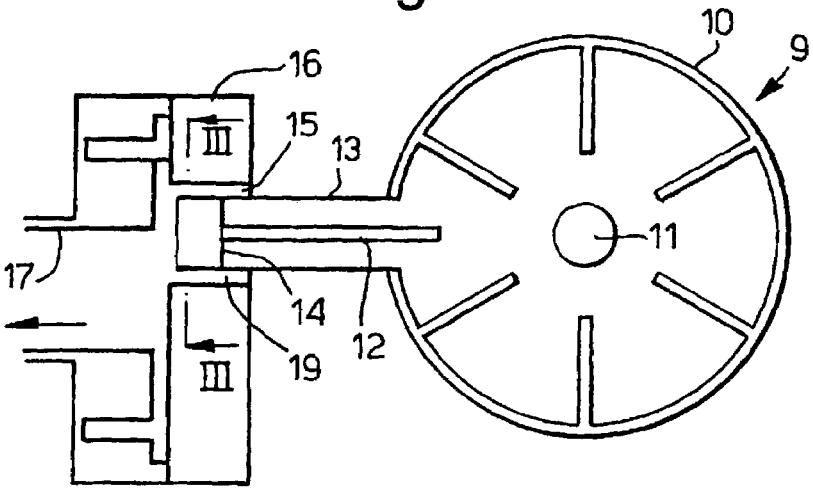
Figure 3:
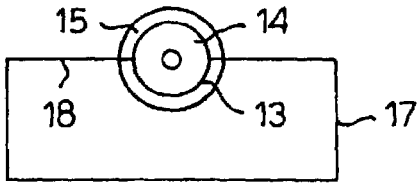

One way in which the invention may be performed is now described by way of example with reference to the accompanying drawings, in which:

FIG. 2 schematically shows in plan view a magnetron arrangement in accordance with the invention; and FIG. 3 schematically shows the arrangement of FIG. 2 along the line III—III.

With reference to FIGS. 2 and 3, a magnetron arrangement in accordance with the invention includes a magnetron 9 having an anode 10 surrounding a central cathode 11. Power is extracted from the magnetron in a conventional manner via a loop 12 and transmitted along a coaxial output line 13. The end of the coaxial output line 13 terminates in a probe 14 which extends through an aperture 15 in a plate 16.

The probe 14 is located adjacent to the end of a rectangular waveguide 17 into which the energy from the magnetron is to be coupled for transmission in the direction shown by the arrow. As can be seen more clearly in FIG. 3, the coaxial output line 13 is aligned relative to the waveguide 17 such that it is in line with the edge of one of the broad walls 18 of the waveguide 17 and at the mid-point of that wall.

In this embodiment, a harmonic choke 19 which is one quarter wavelength long at the second or third harmonic of the operating frequency is included around the probe 14. This acts to filter undesirable output frequencies.

What is claimed is:

1. A magnetron arrangement, comprising: a rectangular waveguide having a broad wall; and a magnetron including a coaxial output having a central conductor, the central conductor having an axis, the coaxial output being coupled in an endfire configuration to the rectangular waveguide, the axis of the central conductor of the coaxial output being aligned with an edge of the broad wall of the rectangular waveguide.

2. The arrangement as claimed in claim 1, wherein the coaxial output is surrounded by a cylindrical wall.

3. The arrangement as claimed in claim 1, wherein the coaxial output is coupled directly to the rectangular waveguide.

4. The arrangement as claimed in claim 1, wherein the central conductor is aligned with a mid-point of the broad wall of the rectangular waveguide.

5. The arrangement as claimed in claim 1, and including a harmonic choke around the coaxial output.

* * * * *